US007243607B2

(12) United States Patent
Chesney et al.

(10) Patent No.: US 7,243,607 B2
(45) Date of Patent: Jul. 17, 2007

(54) WIND DRIVEN SAILING CRAFT

(75) Inventors: John Chesney, St. Saviours (GB); Reginald Clarke, Hook Heath Woking (GB); Andrew Claughton, Southampton (GB)

(73) Assignee: Compass Marine Development Limited, Guernsey (GB)

( * ) Notice: Subject to any disclaimer, the term of this patent is extended or adjusted under 35 U.S.C. 154(b) by 0 days.

(21) Appl. No.: 10/500,484

(22) PCT Filed: Jan. 29, 2003

(86) PCT No.: PCT/GB03/00373

§ 371 (c)(1),
(2), (4) Date: Jun. 30, 2004

(87) PCT Pub. No.: WO03/064247

PCT Pub. Date: Aug. 7, 2003

(65) Prior Publication Data

US 2005/0145156 A1 Jul. 7, 2005

(30) Foreign Application Priority Data

Jan. 30, 2002 (GB) ..... 0202142.6

(51) Int. Cl.
*B63B 1/24* (2006.01)
*B63B 39/06* (2006.01)
*B63H 9/00* (2006.01)

(52) U.S. Cl. ..... 114/39.24; 114/274; 114/280

(58) Field of Classification Search ..... 114/39.11, 114/39.12, 39.13, 39.14, 39.15, 39.21–39.25, 114/274, 280, 281, 282, 285, 126
See application file for complete search history.

(56) References Cited

U.S. PATENT DOCUMENTS

| | | | | |
|---|---|---|---|---|
| 2,703,063 | A * | 3/1955 | Gilruth | 114/280 |
| 3,238,911 | A * | 3/1966 | Pazulski et al. | 114/39.21 |
| 3,968,765 | A * | 7/1976 | Menegus | 114/39.29 |
| 4,193,366 | A * | 3/1980 | Salminen | 114/39.24 |
| 5,103,752 | A * | 4/1992 | Himeda | 114/39.14 |
| 6,578,506 | B2 * | 6/2003 | Bieker | 114/39.24 |

* cited by examiner

*Primary Examiner*—Ajay Vasudeva
(74) *Attorney, Agent, or Firm*—Levy & Grandinetti

(57) ABSTRACT

A wind driven sailing craft is disclosed with a hydrofoil element which provides variable lift to the stern of the craft to maintain a level trim when the craft is operated under power propulsion. The hydrofoil element includes a hydrofoil wing which rotates on a transverse axis to provide the desired lift.

16 Claims, 3 Drawing Sheets

WIND DRIVEN SAILING CRAFT

BACKGROUND OF THE INVENTION

This application is the U.S. National Phase of PCT Application Number PCT/GB03/00373, filed on 29 Jan. 2003, which claims priority to Great Britain Application Number 0202142.6, filed 30 Jan. 2002.

This invention relates to a watercraft which may be used for sailing using wind power, but which can maintain a level trim when mechanically propelled at high speeds.

1. Field of Invention

Sailing craft can be provided with a displacement mono-hull with a transverse cross-section which tapers downwardly on each side to its keel line, and which increases in cross-section from the bow to a fullest transverse section, and decreases in cross section from the fullest transverse section to the after end. Such a mono-hull shape is suitable for sailing because of its streamlined longitudinal shape when upright and when heeled over.

However, displacement mono-hulled sailing craft as described above are not suitable to be mechanically propelled at high speeds. When mechanical propulsion means, for example an outboard motor or a screw, provide high levels of forward thrust to the after end of the hull, the bow is forced out of the water and the aft sinks lower into the water. This slows the craft because its forward facing profile is increased, which results in a greater resistance against the water. The more power which is provided to the after end of the hull, the greater the bow lift and the water resistance. As a result the maximum speed which can be reached is fixed, regardless of the size of the engine. The object of the present invention is to overcome some of these problems and provide a watercraft with a displacement hull which may be used for sailing and be mechanically propelled at high speeds.

2. Description of the Related Art

A previous attempt to provide a watercraft which may be used for sailing and be mechanically propelled at high speeds is shown in shown in GB2150890 in the name of LANCER YACHT CORPORATION.

GB2150890 discloses a combination sailboat-powerboat hull in the form of a round-bottom, ballasted displacement hull, which is provided with generally horizontal foils which extend along the static water line on both sides of the hull, the forward ends of the foils being faired into the hillsides approximately amidships from where the foils extend rearwardly towards the quarters, and the foils extending out from the hullsides a distance less than the thickness of the boundary layer at sailing hull speed, the undersurface area of the foils being such as to enable the hull to plane when driven under auxiliary power.

It has been found that the watercraft disclosed in GB2150890 does not work as claimed. The "foils" described therein are planing surfaces which project from the hull and disrupt its streamlined shape. As a result the "foils" create drag which is detrimental to the performance of the craft when sailed and in particular when heeled over.

In order to minimise this drag, the "foils" are narrow in shape and do not extend through the boundary layer into the laminar zone. As a result the lifting force provided by the "foils" as they plane over the water when the craft is powered by a motor is very small and does not prevent the aft of the craft from sinking lower into the water.

Therefore, in an attempt to minimise the disruptive effect of the "foils" when sailing, they are made so small as to render the invention redundant.

The present invention is intended to provide a novel approach.

BRIEF SUMMARY OF THE INVENTION

Therefore, according to the present invention a wind driven sailing craft with a hull of the displacement type with a keel or keels, is provided with hydrofoil means adapted to lift the stern of the craft when the craft is propelled forwards in use by power propulsion means acting at the stern of the hull.

The hydrofoil means can comprise a flat hydrofoil element, which is attached in a transverse arrangement by struts to the bottom of the after end of the hull of the sailing craft. When the sailing craft is propelled forwards in use by power propulsion means acting at the stern of the hull, the angle of the hydrofoil is set to provide the optimum level of lift to the aft to maintain the optimum trim level for the particular speed of the craft.

As the speed of the craft changes the angle of the hydrofoil element can be adjusted, either manually or automatically, to provide the optimum level of lift to the aft to maintain an optimum trim level at any speed.

Preferably the sailing craft is mono-hulled with a transverse cross-section which tapers downwardly to its keel line, and which increases in cross-section from the bow to a fullest transverse section, and decreases in cross section from the fullest transverse section to the after end. The keel line of the hull tapers downwardly from the bow and the stern to a base line at the fullest transverse section.

The sailing craft can be provided with a drop, or a swing, keel, which is lowered into position to provide ballast when the craft is sailing, and is raised to reduce drag when the craft is propelled forwards by power propulsion means. Further, the craft can also be provided with internal water ballast tanks which can be filled with water to provide ballast when sailing, and emptied to reduce the displacement when the craft is propelled forwards by power propulsion means.

When the craft is being powered by its sails the hydrofoil is set level to the water flow under the after end of the hull so zero lift and minimum drag are provided and the hull operates as a normal sailing hull. It has been found that the hydrofoil provides stability to the hull when the craft is being sailed and acts as a damper in rough conditions, which are additional benefits.

In one construction the hydrofoil is disposed approximately level with the base line of the hull. However, in another construction the hydrofoil is disposed approximately level with the base line of the drop keel. It has been found that with either of these arrangements when the craft is grounded or removed from the water it can be supported in an upright position by the lowest point of the hull or the keel and the hydrofoil, like a tripod, which is an additional benefit.

Preferably, the hydrofoil element is attached to the bottom of the hull by two struts. The hydrofoil element can be substantially rectangular in shape, with the shorter sides thereof disposed substantially parallel to the direction of the hull. Further, the hydrofoil element can have a streamlined cross-section with an elongated tear-drop shape, which passes through the water with the least drag. The hydrofoil element can be adapted to rotate on a transverse axis to provide variable lift to the stern of the sailing craft.

In one construction the struts are provided with rudder elements adapted to steer the craft. The rudder elements can be fixed aft of the struts, can be provided as part of the struts, or the struts can be the rudder elements. With this arrangement a traditional rudder is not required for the craft, which further reduces drag.

The power propulsion means can be an inboard engine, preferably provided with a screw acting at the stern of the hull. The screw can have a known type of blades which can be rotated to be parallel with the direction of the hull to reduce drag when sailing.

In a preferred construction the hydrofoil element can be rotated from a zero lift angle level with the water flow under the aft end of the hull, to a lift angle of approximately −5 to −8 degrees.

The upper hull of the sailing craft can be shaped with a spray rail feature to shield the operators from wash produced at high speeds.

The system can be used on any sailing craft, but in a preferred construction the invention is applied to a 13 meter ocean-going yacht, with about 6 berths.

The invention also includes a hydrofoil element for use with a wind driven sailing craft with a hull of the displacement type with a keel or keels, which is provided with hydrofoil means adapted to lift the stern of the craft when the craft is propelled forwards in use by power propulsion means acting at the stern of the hull.

BRIEF DESCRIPTION OF THE DRAWINGS

The invention can be performed in various ways but one embodiment will now be described by way of example and with reference to the accompanying drawings in which.

DETAILED DESCRIPTION OF THE INVENTION

Figure 1:
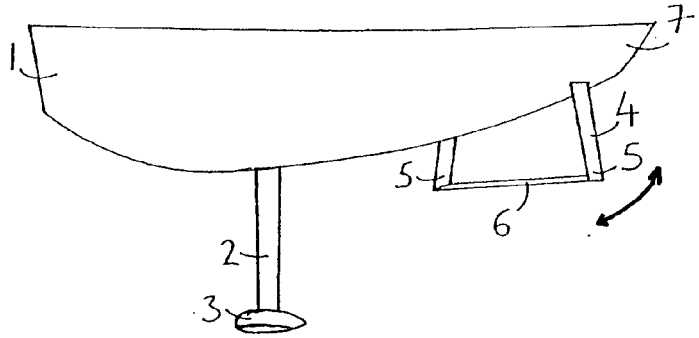
FIG. 1 is a perspective view of a boat hull according to the present invention.
Figure 3A:
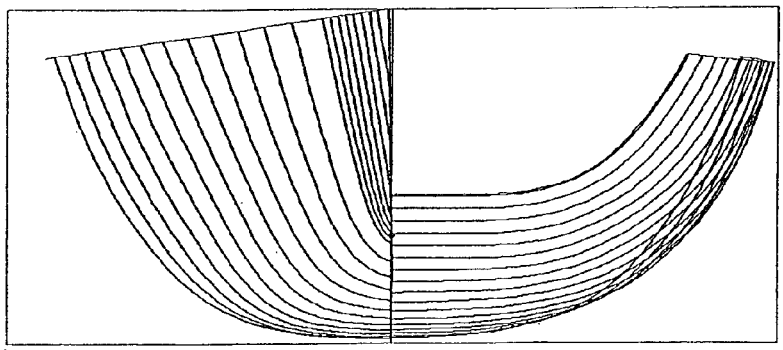
FIG. 3*a* is a diagrammatic front view of the cross sectional contours of the hull shown in both FIGS. 1 and 2.
Figure 3B:
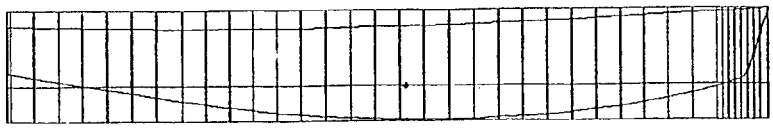
FIG. 3*b* is a diagrammatic side view of the hull shown in FIG. 3*a* with the cross-sectional lines.

FIGS. 1 shows a displacement boat hull 1 which is shaped for sailing and is approximately 13 meters in length. FIGS. 3*a* and 3*b* show the cross-sectional contours of the hull 1. The hull 1 has a broad beam to provide sufficient righting moment to support the sails and provide an adequate lever arm for internal water ballast. In other respects the hull 1 is a shaped for high-speed sailing (approximately 10 knots). As shown in FIG. 1 the hull 1 is provided with a drop keel 2 with a ballast bulb 3, and a hydrofoil element 4. The hydrofoil element 4 comprises two struts 5 and an interconnecting horizontal wing 6. The wing 6 is substantially rectangular in shape with the shorter sides thereof disposed substantially parallel to the direction of the hull 1. The hydrofoil element is mounted adjacent to the aft 7 of the hull 1.

Figure 2:
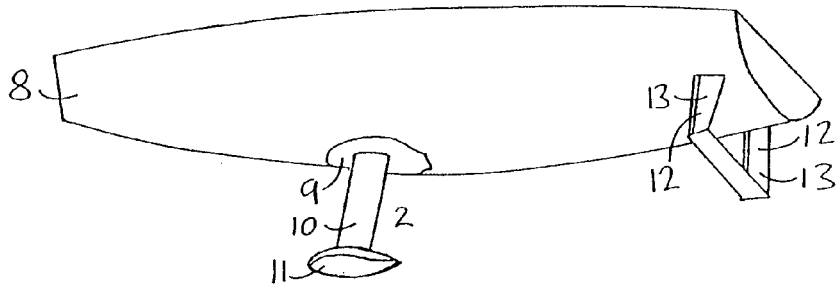
FIG. 2 is a perspective view of another boat hull according to the present invention.

In FIG. 2 displacement boat hull 8 is identical to the hull 1 shown in FIG. 1, except for recess 9 provided on the lower surface. Recess 9 is dimensioned to receive the upper section of the ballast bulb 11 when the keel 10 is raised. Further, struts 12 have been provided with rudder elements 13 to steer the craft.

Figure 4:
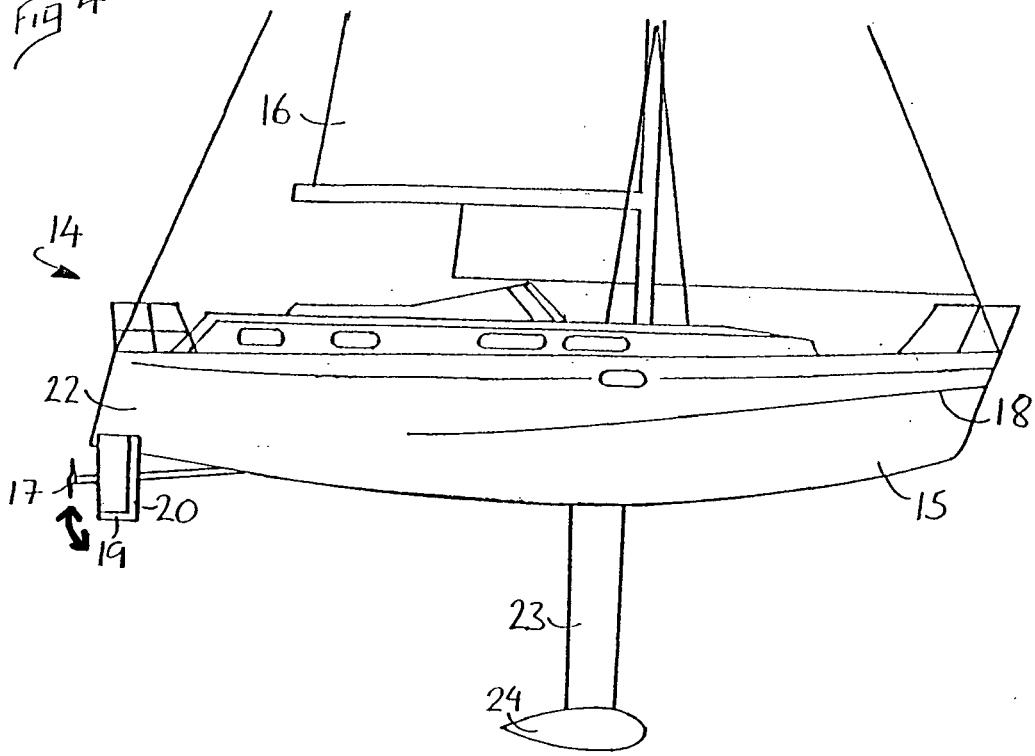
FIG. 4 is a side view of a yacht according to the present invention, arranged for sail operation.
Figure 5:
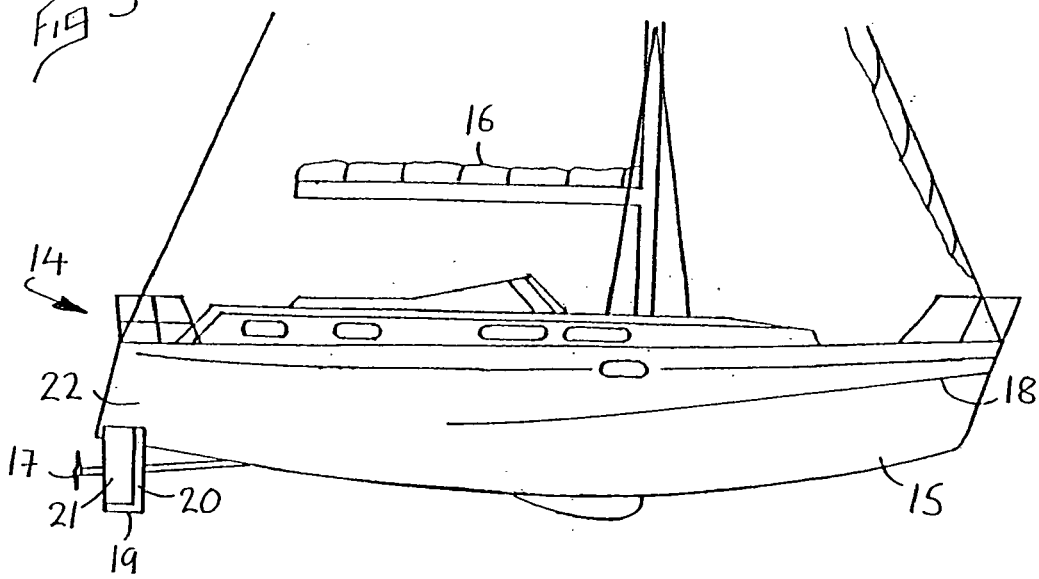
FIG. 5 is a side view of the yacht shown in FIG. 4 arranged for motorised operation.
Figure 6A:
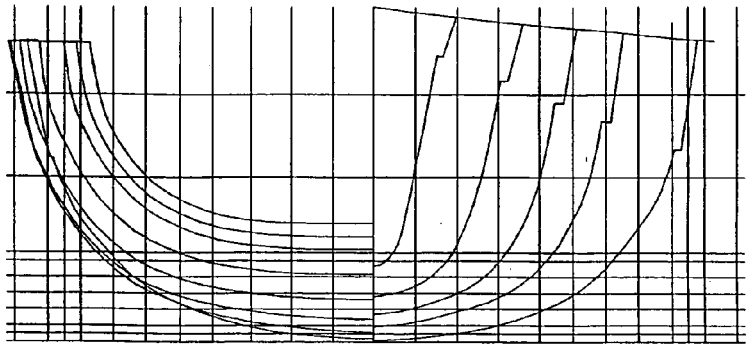
FIG. 6*a* is a diagrammatic front view of the cross sectional contours of the hull shown in both FIGS. 4 and 5; and, FIG. 6*b* is a diagrammatic side view of the hull shown in FIG. 6*a* with the cross sectional lines.
Figure 6B:
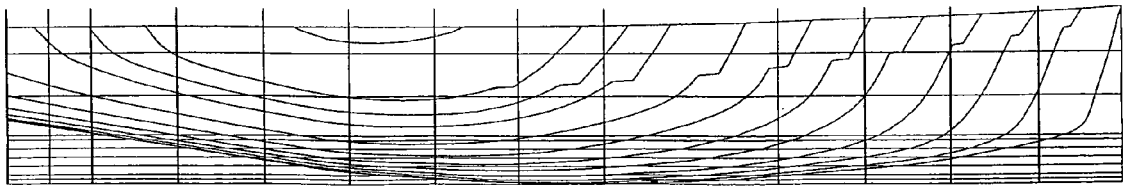

FIGS. 4 and 5 show a displacement mono-hulled 13 meter sailing yacht 14. FIGS. 6*a* and 6*b* show the cross-sectional contours of the hull 15. This type of yacht is known so further details will not be described here. The yacht 14 has a hull 15 shaped for sailing, a sailing rig 16 and a motorised screw 17. The hull 15 is also provided with a spray rail ledge 18 to protect the operators of the craft from wash at high speeds. (The shape of the spray rail 18 can be better seen in FIGS. 6*a* and 6*b*). The yacht 14 is provided with a hydrofoil element 19 comprising two struts 20 (only one shown) and an interconnecting horizontal wing (not shown). The hydrofoil element is identical to that shown in FIG. 2 with rudder elements 21 provided on the struts 20, and it is attached to the bottom of the hull 15, adjacent to the aft 22 of the yacht 14. The yacht 14 is also provided with a drop keel 23 with a ballast bulb 24. The hull 15 also features a recess (not shown) into which the upper section of the ballast bulb 24 can fit when the drop keel 23 is raised.

As shown in FIG. 4 the yacht 14 is set for sail operation with the sailing rig 16 arranged to provide propulsion. The wing (not shown) of the hydrofoil element 19 is set level to the water flow under the after end 22 of the hull so zero lift and minimum drag are provided and the hull 15 can operate as normal.

As shown in FIG. 5 the yacht is set for powered operation with the sailing rig 16 lowered. The drop keel 23 has been raised and the upper section of the ballast bulb 24 has been received by the recess (not shown) in the bottom of the hull 15. When the screw 17 pushes the yacht through the water at high speeds the wing (not shown) of the hydrofoil element 19 is set at a negative angle and the higher water pressure on the underside of the wing creates lift and holds the yacht 14 at a level trim.

As the speed of the yacht changes the wing is adjusted automatically to provide the optimum level of lift to the aft to maintain an optimum trim level. It will be appreciated that the speed of the yacht can be changed by engine speed as well as sea and weather conditions and any angle of turn, so the wing can be set to respond to these changes to maintain a level trim. It will also be appreciated that the correct wing angles required at high speeds will depend on the size, displacement and engine capacity of the craft with which is it used.

The yacht 14 can be provided with internal water ballast tanks on each side of the hull 15 approximately amidships, in order to provided extra righting moment during sailing. The tanks can be filled automatically when the yacht 14 is in sailing mode, as shown in FIG. 4, and then emptied to reduce weight and displacement when the yacht 14 is in motor mode, as shown in FIG. 5.

The spray rail 18 protects the occupants of the yacht 14 from water spray created by the high speed of the yacht 14.

Although the above describes the invention as applied to a displacement mono-hulled sailing craft, it will be appreciated that the invention can also be applied to a multi-hulled sailing craft. Further, a hydrofoil wing can be attached to the underside of the aft of a sailing craft in any appropriate manner, for example by one or three struts. In addition, if desired the hydrofoiling effect can be achieved by a number of hydrofoil wings attached to the underside of the hull in any appropriate manner.

The invention claimed is:

1. A wind driven sailing craft with a hull of the displacement type with a keel or keels, comprising a hydrofoil element and power propulsion means at the stern, and wherein the hydrofoil element at the stern:

is attached to the underside of the hull by two struts;

is adapted to rotate on a transverse axis to provide variable lift to the stern of the sailing craft;

has a first position for use when the craft is propelled under sail power, in which it provides substantially no lift to the stern of the sailing craft; and has additional variable positions for use when the sailing craft is propelled under the power propulsion means, which provide lift to the stern of the sailing craft to such a degree that the sailing craft is maintained at a substantially level trim.

2. A wind driven sailing craft as claimed in claim 1, in which the displacement hull is a mono-hull shaped for high-speed sailing, with a transverse cross-section which tapers downwardly to its keel line, and which increases in cross-section from the bow to a fullest transverse section, and decreases in cross-section from the fullest transverse section to the after end, and in which the keel line of the hull tapers downwardly from the bow and the stern to a base line at the fullest transverse section.

3. A wind driven sailing craft as claimed in claim 1 in which the hydrofoil element comprises a substantially rectangular shaped hydrofoil element and in which the shorter sides thereof are disposed substantially parallel to the direction of the hull, and which is adapted to rotate on a transverse axis to provide variable lift to the stern of the craft.

4. A wind driven sailing craft as claimed in claim 1 in which the hydrofoil element is rotatable in use from a substantially no lift angle level with the water flow under the after end of the hull, to a lift angle of approximately −5 to −8 degrees.

5. A wind driven sailing craft as claimed in claim 4 in which the struts are provided with rudder elements adapted to steer the craft.

6. A wind driven sailing craft as claimed in claim 5 which is provided with a drop keel, which is lowered into position to provide ballast when the craft is sailing and is raised when the craft is propelled mechanically.

7. A wind driven sailing craft as claimed in claim 6 in which the keel is provided with a ballast bulb.

8. A wind driven sailing craft as claimed in claim 7 in which a recess is provided in the hull, adapted to receive the upper portion of the ballast bulb when the keel is raised.

9. A wind driven sailing craft as claimed in claim 8 which is provided with internal water ballast tanks which are filled with water when the craft is sailing in use, and emptied when the craft is propelled forwards in use by power propulsion means.

10. A wind driven sailing craft as claimed in claim 9 in which the hydrofoil element is disposed substantially level with the base line of the hull.

11. A wind driven sailing craft as claimed in claim 10 in which the hydrofoil element is provided with an elongated tear-drop shaped cross-section.

12. A wind driven sailing craft as claimed in claim 11 in which the power propulsion means is an inboard engine provided with an outboard screw propeller acting at the stern of the hull.

13. A wind driven sailing craft as claimed in claim 12 in which the blades of the propeller are adapted to be rotated to be substantially parallel with the direction of the hull when the craft is sailing in use to reduce drag.

14. A wind driven sailing craft as claimed in claim 13 in which the hull is shaped with a spray rail.

15. A wind driven sailing craft as claimed in claim 14 in which the watercraft is an approximately 6 berth 13 meter ocean-going yacht.

16. A wind driven sailing craft as claimed in claim 9 in which the hydrofoil element is disposed substantially level with the base line of the drop keel when it is in its lowered position.

* * * * *